US006053109A

United States Patent [19]

Rüdenauer

[11] Patent Number: 6,053,109

[45] Date of Patent: Apr. 25, 2000

[54] TRIGGERING ARRANGEMENT FOR THE PRIMING OF AN ANTI-SHELTER PROJECTILE

[75] Inventor: Werner Rüdenauer, Roth, Germany

[73] Assignee: Diehl Stiftung & Co., Nürnberg, Germany

[21] Appl. No.: 07/409,516

[22] Filed: Sep. 14, 1989

[30] Foreign Application Priority Data

Oct. 5, 1988 [DE] Germany ..... 38 33 751

[51] Int. Cl.[7] ..... F42C 9/00; F42C 11/06

[52] U.S. Cl. ..... 102/266; 102/215; 102/216

[58] Field of Search ..... 102/210, 215, 102/216, 265, 266, 489

[56] References Cited

U.S. PATENT DOCUMENTS

| | | | |
|---|---|---|---|
| 3,722,416 | 3/1973 | Lunt et al. | 102/270 |
| 3,788,225 | 1/1974 | Held | 102/499 |
| 4,375,192 | 3/1983 | Yates et al. . | |
| 4,387,649 | 6/1983 | Weidner et al. . | |
| 4,480,550 | 11/1984 | Abt . | |
| 4,522,356 | 6/1985 | Lair et al. | 244/3.15 |
| 4,580,498 | 4/1986 | Abt et al. | 102/215 |
| 4,586,386 | 5/1986 | Hollstein et al. . | |
| 4,667,598 | 5/1987 | Grobler et al. | 102/215 |
| 4,703,693 | 11/1987 | Spies et al. | 102/215 |
| 4,727,810 | 3/1988 | Furst et al. | 102/263 |
| 4,799,427 | 1/1989 | Held et al. | 102/215 |

FOREIGN PATENT DOCUMENTS

| | | |
|---|---|---|
| 0057296 | 12/1981 | European Pat. Off. . |
| 0100130 | 2/1984 | European Pat. Off. . |
| 0121494 | 10/1984 | European Pat. Off. . |
| 1534237 | 11/1978 | United Kingdom . |

OTHER PUBLICATIONS

Miltech, *MW–1 The Multi–Purpose Weapon System,* 1985, vol. 2, pp. 64 & 72.

*Primary Examiner*—Charles T. Jordan
*Attorney, Agent, or Firm*—Scully, Scott, Murphy & Presser

[57] ABSTRACT

A triggering arrangement for the priming or initiation of an anti-shelter projectile and more particularly, the triggering or detonation of the warhead of the projectile subsequent to the penetrating of the shelter wall structure. The triggering arrangement is provided with a time-delay device which delivers a trigger-releasing signal in dependence upon reaching of the entry of the through-passage into the shelter wall or the exit from the passage through the shelter wall.

6 Claims, 2 Drawing Sheets

TRIGGERING ARRANGEMENT FOR THE PRIMING OF AN ANTI-SHELTER PROJECTILE

BACKGROUND OF THE INVENTION

1. Field of the Invention

The present invention relates to a triggering arrangement for the priming or initiation of an anti-shelter projectile, and more particularly, for the triggering or detonation of the warhead of the projectile subsequent to the penetrating of the shelter wall structure.

2. Discussion of the Prior Art

From the disclosure in the publication MILTECH, Vol. 2/1985, at the middle of the left-hand column on page 72, it has become known to employ tandem projectiles for the attacking of objects which are parked or stored under the protection of shelters, whereby the projectiles work themselves into the shelter wall structure through the intermediary of a blasting charge and, from therein, trigger a secondary hollow charge into the interior of the shelter.

SUMMARY OF THE INVENTION

Accordingly, it is an object of the present invention to provide a triggering arrangement of the above-mentioned type, which, due to its configuration and high kinetic energy, is in particular utilizable for projectiles employed in penetrating the shelter wall and which afford for an optimized detonating or triggering timepoint relative to the entry of the projectile into the interior of the shelter.

The foregoing object is inventively attained in that the triggering arrangement of the type which is considered herein is provided with a time-delay device which delivers a trigger-releasing signal in dependence upon reaching of the entry of the through-passage into the shelter wall or the exit from the passage through the shelter wall.

In accordance with the foregoing, assurance is provided that the warhead which has arrived in the interior of the shelter with the penetrating projectile will not be already triggered or detonated during the penetrating of the shelter wall, but; in essence, will develop its optimum effect in the interior of the shelter. This is because the time-delay device can be set to a delay value or time lag on the basis of empirical findings which, under typical penetrating conditions, corresponds to the maximum time period for the penetrating of the shelter wall.

In order to be able to always consider the penetrating period which, in practice, nevertheless extensively fluctuates in dependence upon the type of shelter construction and upon the geometric penetrating conditions, and to detonate the warhead as closely as possible to the center region of the interior of the shelter; in effect, in proximity to the center-point of the cross-section of a shelter, there is expediently selected a variable time delay or lag which is dependent upon the time for penetrating the wall in order to initiate the triggering or detonation after the entry of the projectile into the interior of the shelter. The reason for this resides in that the speed of travel for the projectile within the interior of the shelter is representable under specified impact-system data in a good approximation as a linear dependency upon the difference in the time between the entry of the projectile into the wall and exit thereof from the wall. In consequence thereof, the range of dispersion for the detonation timepoint can be essentially limited to the dispersion parameters, which are given by the entry location and the entry angle of the projectile into the shelter wall which it is to penetrated for access into the interior of the shelter.

However, in the event that the projectile should strike against a solid object in the interior of the shelter, then the detonation is immediately expediently initiated; in effect, there is no wait for the delay period or time lag which is dependent upon the time for the penetrating. The foregoing will ensure that the projectile will not simply smoothly punch through an object which is located or parked in the shelter; for example, only first after a penetration into the region of construction located opposite the through-passage (the floor or wall of the shelter), and would thereby be detonated under inexpedient or ineffective detonating conditions.

BRIEF DESCRIPTION OF THE DRAWINGS

Additional alternatives and modifications, as well as further features and advantages of the invention may now be readily ascertained from the following detailed description of an exemplary embodiment of the invention, taken in conjunction with the accompanying drawings; in which.

DETAILED DESCRIPTION

Figure 1:
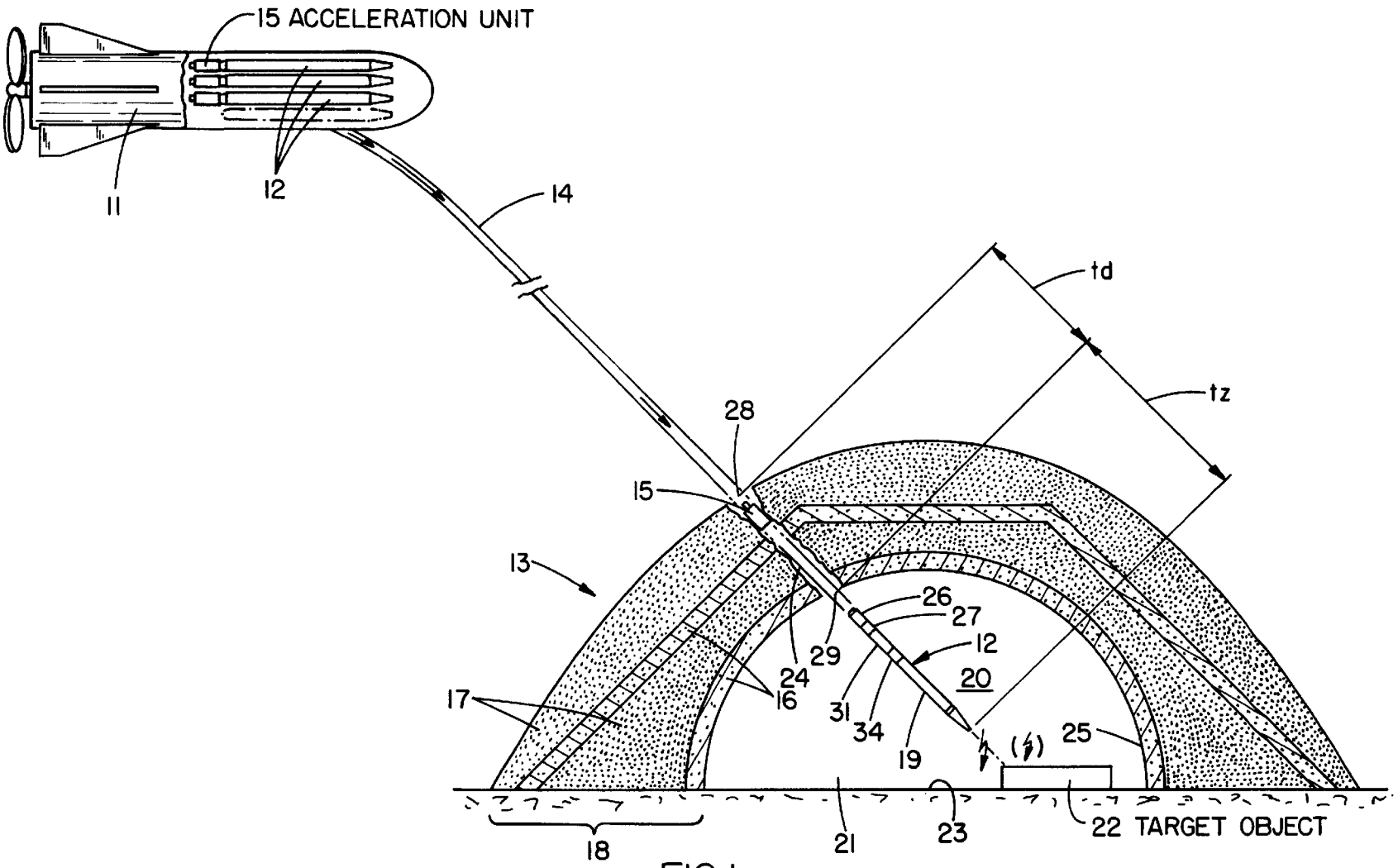
FIG. 1 illustrates an elevational sectional view of a typical shelter structure, as well as the deployment and penetration of a projectile into such a shelter.

Through the intermediary of a manned or unmanned carrier 11, such as is disclosed, for example, in U.S. Pat. No. 4,522,536 for the case of submunition-projectiles deployed which are deployed against armored vehicles used in combat areas, a plurality of projectiles 12 are conveyed into proximity to above-ground armored protective structures, such as, especially so-called aircraft shelters or revetments 13. After their release from the carrier 11, the projectiles 12 are maneuvered either remote-controlled or automatically-guided against the shelter 13 in an attacking trajectory 14 which is inclined at an angle of about 45° relative to the horizontal, so as to in this spatial orientation start up a secondary or past-acceleration unit 15, somewhat such as a rocket engine. The projectiles 12 are designed with regard to their frontal geometry, their kinetic energy and their mechanical capacity to withstand stresses, for the purpose of being able to penetrate shelter wall 18, which in cross-section is built up from sequences of concrete structures 16 and earth embankments 17, and in vertical cross-section is somewhat semicircular. The warhead 19 in the projectile 12 should be detonated when the latter has worked itself through the shelter wall 18 and is located generally in the center region 20 of the shelter interior 21; however, at the latest when the projectile 12 again strikes against an obstruction after having penetrated the shelter wall 18, which can pertain to an object 22 protected in the shelter 13 or, in accordance with the geometric conditions, can pertain to the shelter floor 23 or, in essence, the interior wall 25 of the shelter which is located opposite the penetrating passage 24. However, an effort is made to have the warhead 19 of the projectile brought to detonation in the center region 20, inasmuch as it then evidence the greatest gas impact and splinter or fragmentation effect against objects 22 which are parked or stored in the interior 21 of the shelter.

In dependence upon the conditions, or delivery or deploying generally because of release from the carrier 11, such as is described in U.S. Pat. No. 4,727,810, or in dependence upon the transient operation of the secondary or past-acceleration unit 15, there unlatches a safe-and-arm device 26 and thereby mechanically and/or electrically releases an inertial sensor 27. With respect to the latter, this can pertain to a piezo-transducer which reacts to mechanical stresses or strains, or to a mechanical spring-mass system incorporating contacts closing in dependence upon encountered inertial forces. In any event, the inertial sensor 27 delivers an applicable delay or time lag information 30, in dependence upon the entry 28 into as well as upon the exit 29 from the shelter wall 18, to a detonation triggering device 31 on board the projectile 12. For the illustration which is shown in FIG. 1, it is assumed that the past-acceleration unit 15 is at the tail end of the projectile 12 will tear off therefrom upon the entry of the latter into the through-passage 28, and remains stuck in the passage 24; however, this is not an absolutely necessary condition.

In the simplest type of embodiment for a detonation initiating device 31 provision can be made, in dependence upon the entry 28 into the passage or exit 29 from the passage, that from the applicable slope of the plotted curve of the inertial information 30, there is started a time delay or lag device 32 for the delayed transmission of a detonation release signal 33 to a fuze or detonator 34. Concerning this time-delay device 32, the latter can basically be a mechanical retard or braking mechanism which actuates a limit switch after the completion of a specified time interval; however, or it may relate to an electronic timing circuit 35 of somewhat the construction of a rhythmic counter which will emit the signal 33 upon the reaching of a specified count condition. However, it is disadvantageous in that type of design for the detonation triggering device 31 that it operates with a detonation lag or delay period tz which must be precedingly estimated and fixedly specified, whereas the penetrating kinematics of the projectile 12 into the shelter 13 extensively depends upon the ballistic and constructive conditions, especially upon the sequence and strength of concrete structures 16' arranged intermediate earth embankments 17' which are soft in comparison therewith. Consequently, there is thus no adequate assurance that the warhead 19 will be disintegrated in the center region 20, inasmuch as in accordance with encountered disruptive influences, a detonation can already take place within the shelter wall 18 or possibly only after first passing through the interior 21 of the shelter and thereby carried out in an ineffective constellation.

Figure 2:
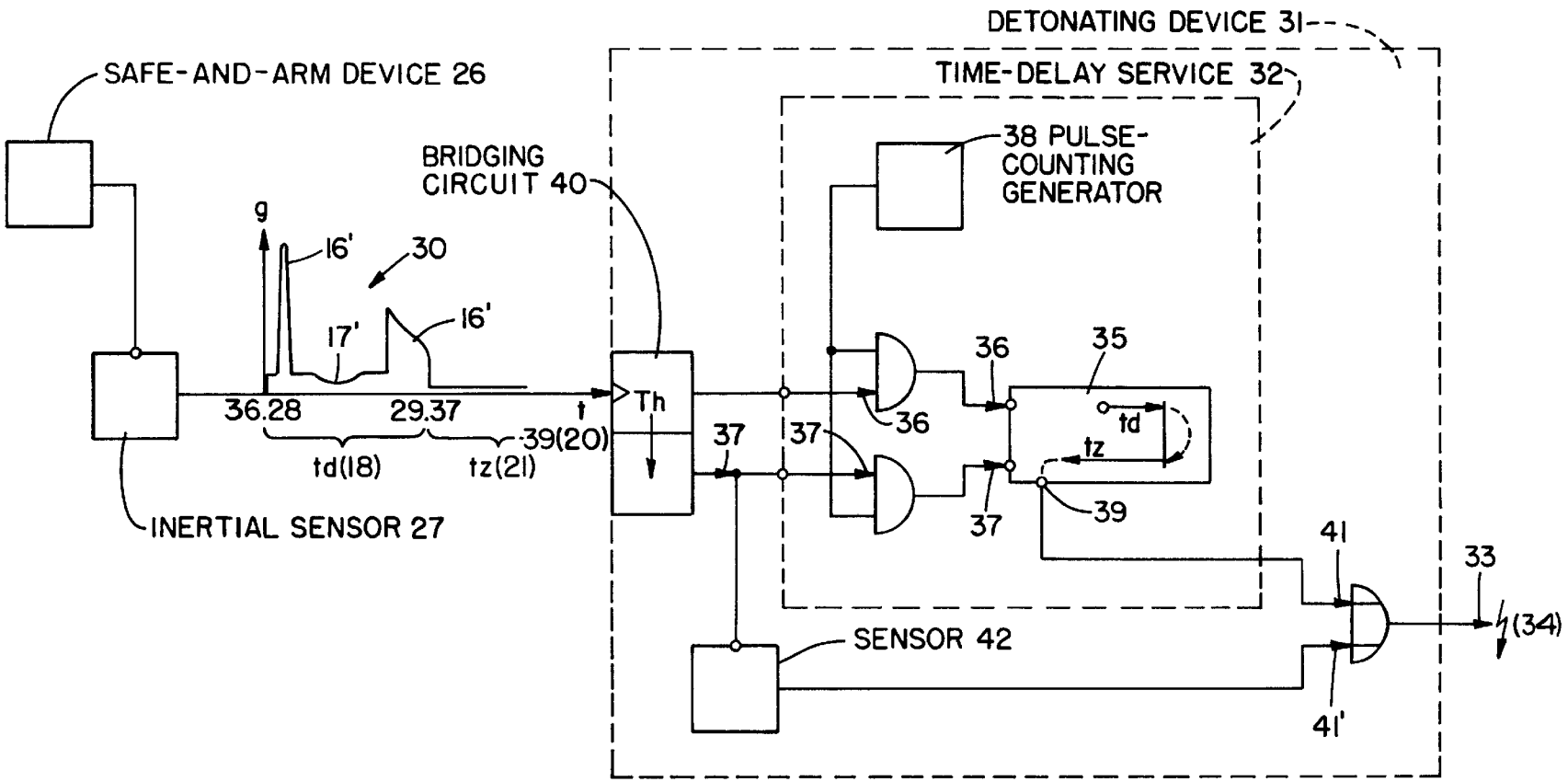
FIG. 2 illustrates in a unipolar block circuit diagram, with consideration to the delay or lag time-cycle encountered during the penetration of the shelter wall, a triggering circuit for the detonation of the warhead of the projectile which has penetrated into the shelter.

Consequently, in view of the foregoing, the detonation triggering device 31 is expediently equipped with a variably adjustable time-delay device 32, namely, in dependence upon the delays or time lags which are encountered during traveling through the penetrating passage 24. For this purpose, pursuant to the ratchet principle (mechanical directional latching device) there can be provided a chargeable braking mechanism, which is increasingly tensioned the more extensive, and in any case, the lengthier are the delays which are encountered during passage through the wall 18. However, in the example as shown in FIG. 2, it is contemplated to start a counting timing circuit 35 by means of an entry signal 36 and to thereafter measure the running time td. A detonation delay or lag time tz which is dependent upon this measured result will then start from the appearance of the exit signal 37. As is illustrated in FIG. 2, this time delay period tz for the detonation, which is dependent upon the running through, can be obtained extremely simply in the circuitry technology, in that commencing from the appearance of the entry signal 36 and until the appearance of the exit signal 37, the timing circuit 35 is counted forwardly from a pulse-counting generator 38. From the count condition which is reached at the occurrence of the exit signal 37, which corresponds to the running time td, there is then counted backwardly until the reaching of an end position 39, as a result of which the detonation delay-time tz will increase in accordance with the extent of the previously encountered running time td. Upon reaching of this end position 39, the detonation release signal 33 is then transmitted to the detonator or fuze 34.

In conformance with the cross-sectional structure of the shelter wall 18, generally due to differing material densities or because of hollow interspaces which must be traversed, this can always lead to fluctuations in the inertial information 30 (region 17' in FIG. 2), and thereby to temporary disruptions of the entry signal 36, which are not (yet) allowed to act as the end of the signal thereby as the exit signal 37 on the functioning of the time-delay device 32. In view of this aspect, there is provided a bridging circuit 40 which will block off such fluctuations and disruptions and only when the demands on the inertial sensors 27 due to sounds passing through solids or, in essence, the time-delay acting thereon, has definitely been completed, will the exit signal 37 connect through. This bridging circuit 40 is illustrated in FIG. 2 as a monostable flip-flop for the pausing period Th; meaning that only first at the absence of the entry signal 36 over a lengthier time interval than the specified pausing period Th, will the flip-flop which is set from the commencement of the inertial information 30 be tipped back into its stable condition, which leads to the emitting of the exit signal 37. In this system, the pausing period Th is thus required to be shorter than the running period td which is to be expected, and which is typical for this scenario. When the pausing period Th is not negligible in comparison with the average specified (and, in dependence upon the running time td, variable) detonation delay-time tz, then it must be considered in the measurement of the latter.

Instead of the flip-flop, for the bridging circuit 40 there can also be provided a time-comparator circuit. Also this circuit delivers the exit signal 37 for the starting of the detonation delay-time period tz, and only then when the inertial signal 30 has dropped down and remains below a significant threshold not only for a short period of time, but over a minimum time interval.

Within the interior 21 of the shelter there are also conceivable constellations at which the warhead 19 should already detonate prior to the occurrence of the delayed triggering or detonating information 41. This is generally the case when the projectile 12 strikes a solid object subsequent to the exit 29 from the through passage whereby, in accordance with the geometric conditions, this can relate to the shelter floor 23, the interior wall 25 of the shelter which is located opposite the penetrating passage 24, or an object 22 which is parked or positioned in the interior 21 of the shelter. At an applicable impact after the occurrence of the exit signal 37, the previously mentioned inertial sensor 27 or an additionally provided sensor 42 which responds to body or solids sound or to time delays, will immediately deliver a triggering information 41' for the actuation of the detonator or fuze 34.

What is claimed is:

1. Triggering arrangement for the initiating the detonation of a warhead of an anti-shelter projectile after penetrating of a shelter wall by said projectile; comprising time-delay means for delivering a detonating trigger signal in dependence upon travel of said projectile through a passage formed thereby in the shelter wall, said time-delay means delivering a triggering information for a variable time-delay period commencing from the projectile reaching the exit of the passage thereof through said shelter wall within the shelter, said delay period being dependent upon the time of travel of said projectile between the entry into and exit thereof from said passage through said shelter wall.

2. Triggering arrangement as claimed in claim 1, wherein said time-delay means is activated upon said projectile exiting from the passage thereof through the shelter wall into said shelter.

3. Triggering arrangement as claimed in claim 1, wherein said time-delay means is actuatable across a bridging circuit for the elimination of short-term disruptions of inertial information obtained during the time of travel through said passage.

4. Triggering arrangement as claimed in claim 3, wherein said bridging circuit comprises a monostable flip-flop which is settable by an entry-sensing inertial sensor.

5. Triggering arrangement as claimed in claim 1, comprising an inertial sensor for the emitting of a signal indicative of said projectile contacting the shelter wall upon entry therein and of a signal indicative of exiting from said wall for the start of a forward counting sequence and a subsequent backward counting sequence of a timing circuit for the delivery of a triggering information to said warhead which is delayed with respect to the exit-indicating signal.

6. Triggering arrangement as claimed in claim 1, comprising an impact sensor which is activated by a signal indicative of the exit of said projectile from the passage formed thereby in said shelter wall for the delivery of an immediate triggering information to said warhead.

* * * * *